US008745992B2

(12) United States Patent
Cheong et al.

(10) Patent No.: US 8,745,992 B2
(45) Date of Patent: Jun. 10, 2014

(54) REFRIGERATOR

(75) Inventors: Young Min Cheong, Seoul (KR); Seok Uk Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 315 days.

(21) Appl. No.: 13/200,334

(22) Filed: Sep. 23, 2011

(65) Prior Publication Data

US 2012/0096872 A1 Apr. 26, 2012

(30) Foreign Application Priority Data

Oct. 20, 2010 (KR) ..... 10-2010-0102394

(51) Int. Cl.
*F25B 21/02* (2006.01)

(52) U.S. Cl.
USPC ..... 62/3.3; 62/340

(58) Field of Classification Search
CPC ..... F25B 21/00; F25B 21/04; H01L 35/00; H01L 35/34; F25C 5/007; F25C 2700/00; F25D 23/065
USPC ..... 62/3.3, 3.6, 340, 344, 449, 135; 312/401, 405
See application file for complete search history.

(56) References Cited

U.S. PATENT DOCUMENTS

| | | | | |
|---|---|---|---|---|
| 6,250,084 | B1 * | 6/2001 | Sato et al. | 62/3.64 |
| 6,715,299 | B2 * | 4/2004 | Kim et al. | 62/3.6 |
| 6,820,433 | B2 * | 11/2004 | Hwang | 62/3.63 |
| 6,895,762 | B1 * | 5/2005 | Lin | 62/3.3 |
| 7,832,227 | B2 * | 11/2010 | Wu et al. | 62/344 |
| 8,147,015 | B2 * | 4/2012 | Kim et al. | 312/405 |
| 8,151,590 | B2 * | 4/2012 | Flores et al. | 62/264 |
| 2006/0196214 | A1 * | 9/2006 | Lee et al. | 62/344 |

* cited by examiner

*Primary Examiner* — Mohammad M Ali
(74) *Attorney, Agent, or Firm* — Staas & Halsey LLP

(57) ABSTRACT

A refrigerator includes a main body provided with a storage chamber, a door to open and close the storage chamber, and an ice maker to make ice cubes, wherein the door includes a receiving chamber provided at a front surface of the door to receive the ice maker and an auxiliary door to open and close the receiving chamber. Accordingly, since the receiving chamber may be opened through the auxiliary door without opening of the door, the ice maker may be conveniently cleaned or repaired.

14 Claims, 6 Drawing Sheets

REFRIGERATOR

CROSS-REFERENCE TO RELATED APPLICATIONS

This application claims the benefit of Korean Patent Application No. 10-2010-0102394 filed on Oct. 20, 2010 in the Korean Intellectual Property Office, the disclosure of which is incorporated herein by reference.

BACKGROUND

1. Field

Embodiments of the present disclosure relate to a refrigerator having a structure in which an ice maker to make ice cubes is installed at a door.

2. Description of the Related Art

In general, a refrigerator includes components of a refrigeration cycle therein. The refrigerator is an apparatus to preserve food stored therein in a frozen or refrigerated state by cold air generated through an evaporator of the refrigeration cycle.

Such a refrigerator includes a main body provided with a storage chamber for food, and a door to open and close the storage chamber. The main body is equipped therein with the components of the refrigeration cycle such as a compressor, an evaporator, a condenser, and an expansion valve. Thus, food stored within the storage chamber may be preserved at low temperature by supply of the cold air generated through the evaporator of the refrigeration cycle to the storage chamber.

Also, the door in the refrigerator is installed with an ice maker to make ice cubes using the cold air transferred from the storage chamber, and a dispenser to extract ice cubes made in the ice maker to the outside.

SUMMARY

Therefore, it is an aspect of the present disclosure to provide a refrigerator in which repair or cleaning of an ice maker is more convenient.

Additional aspects of the disclosure will be set forth in part in the description which follows and, in part, will be apparent from the description, or may be learned by practice of the disclosure.

In accordance with one aspect of the present disclosure, a refrigerator includes a main body provided with a storage chamber, a door to open and close the storage chamber, and an ice maker to make ice cubes, wherein the door includes a receiving chamber provided at a front surface of the door to be recessed so as to receive the ice maker, and an auxiliary door to open and close the receiving chamber.

The auxiliary door may be rotatably mounted, at one side thereof, at the door to open and close the receiving chamber through rotation of the auxiliary door.

The refrigerator may further include a dispenser arranged at a lower side of the ice maker in the receiving chamber to discharge ice cubes made by the ice maker to the outside, and the auxiliary door may be provided with an ice cube discharge hole to receive ice cubes discharged through the dispenser at the outside of the door.

The refrigerator may further include an ice cube storage container arranged in parallel with the dispenser to store ice cubes, and an ice cube feed device arranged between the ice maker and the dispenser to feed ice cubes made by the ice maker into one of the dispenser and the ice cube storage container.

The ice maker may include an ice making tray to make ice cubes, and a first Peltier element to absorb heat of the ice making tray through one side of the first Peltier element and emit the heat through the other side thereof.

The ice maker may further include a first radiating fin arranged to come into contact with the other side of the first Peltier element and a radiating fan to allow outside air to exchange heat with the first radiating fin, and the door may be provided with a heat emission hole to allow the outside air to flow through the first radiating fin.

The heat emission hole may be provided at an upper end of the door, and the heat emission hole may be arranged with the radiating fan and is arranged, at a lower side thereof, with the first radiating fin.

The ice maker may further include an insulating member arranged between the first radiating fin and the ice making tray, and a first heat transfer member to transfer heat to the first Peltier element through the insulating member.

The ice maker may further include a second radiating fin arranged in parallel with the ice making tray, a second Peltier element to absorb heat from the second radiating fin through one side of the second Peltier element and transfer the heat to the first radiating fin, a circulation fan to allow air within the receiving chamber to exchange heat with the second radiating fin, and a second heat transfer member to transfer heat to the second Peltier element through the insulating member.

In accordance with another aspect of the present disclosure, a refrigerator includes a main body provided with a storage chamber, an ice maker to make ice cubes, and a door provided with a receiving chamber to receive the ice maker while opening and closing the storage chamber, wherein the ice maker includes an ice making tray to make ice cubes and a first Peltier element to absorb heat of the ice making tray through one side of the first Peltier element and emit the heat through the other side thereof, and the door has a heat emission hole to allow the heat emitted through the other side of the first Peltier element to exchange heat with outside air.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
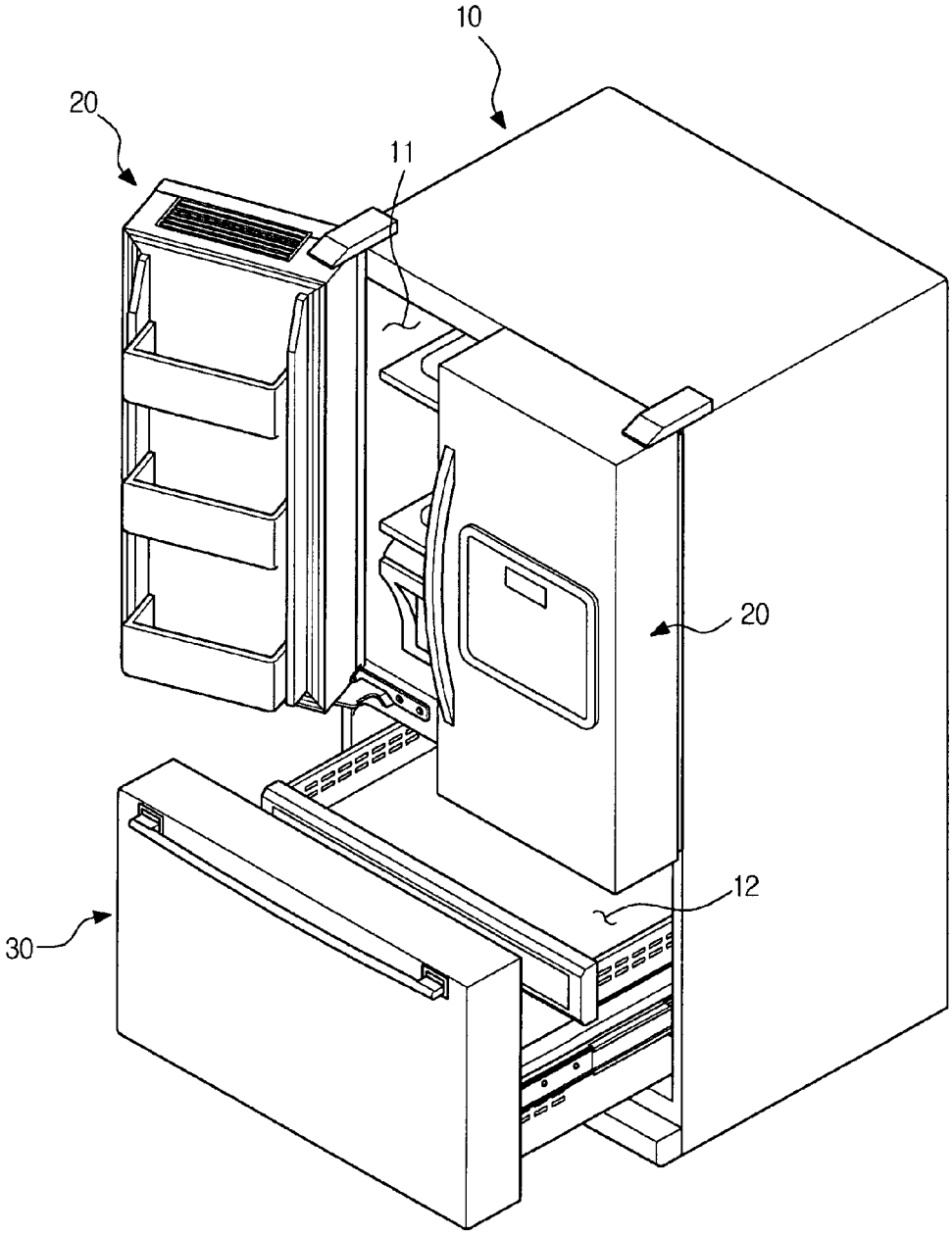
FIG. 1 is a perspective view illustrating a refrigerator according to an exemplary embodiment of the present disclosure.

Reference will now be made in detail to the embodiments of the present disclosure, examples of which are illustrated in the accompanying drawings, wherein like reference numerals refer to like elements throughout.

As shown in FIG. 1, a refrigerator according to an exemplary embodiment of the present disclosure includes a main body 10 provided dividedly with a plurality of storage chambers 11 and 12 to store food therein while defining an external appearance of the refrigerator. In the present exemplary embodiment, the storage chamber is vertically divided into a refrigerating chamber 11 to keep food refrigerated at an upper side thereof and a freezing chamber 12 to keep food frozen at a lower side thereof.

The main body 10 is provided, at opposite sides of an upper portion thereof, with a pair of doors 20. One side end of each door 20 is rotatably mounted at the main body 10 so that opposite sides of the refrigerating chamber 11 are respectively opened by the doors 20. The freezing chamber 12 is movably installed with a storage drawer 30 to store food therein.

Although not shown in the drawings, the main body 10 is equipped therein with components of a refrigeration cycle, such as a compressor to compress refrigerant, a condenser to allow the refrigerant to be cooled through heat exchange with outside air of the main body, an expansion valve to decompress and expand the refrigerant, and an evaporator to generate cold air through absorption of heat from air within the refrigerating and freezing chambers. In accordance with such a configuration, the cold air generated in the evaporator is supplied to the refrigerating and freezing chambers 11 and 12 to cool the refrigerating and freezing chambers 11 and 12, so that food within the refrigerating and freezing chambers 11 and 12 may be preserved at low temperature.

Figure 2:
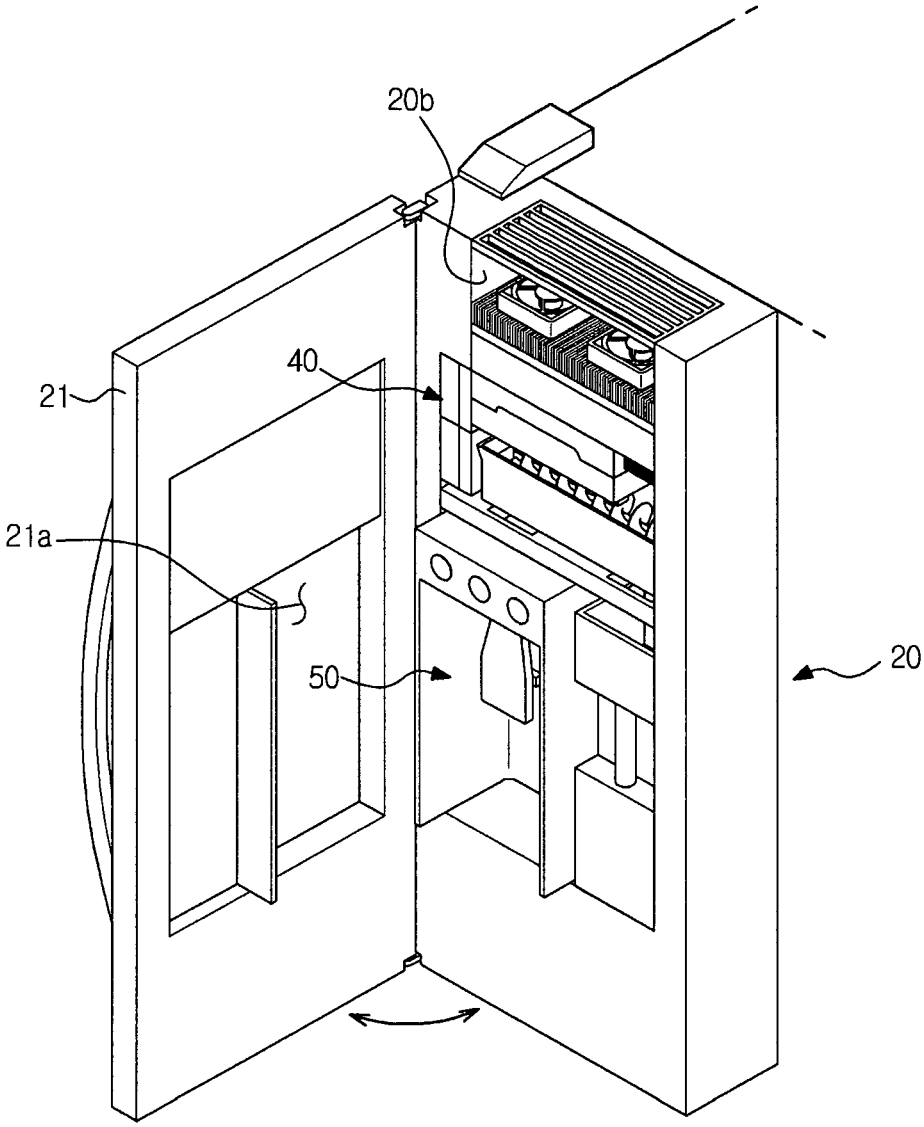
FIG. 2 is a perspective view illustrating an ice maker installed in the refrigerator according to the exemplary embodiment of the present disclosure.

In the present exemplary embodiment, one of the doors 20 is equipped with an ice maker 40 to make ice cubes and a dispenser 50 to allow a user to receive the ice cubes made by the ice maker 40 at the outside of the corresponding door 20, as shown in FIG. 2.

The door 20 is provided, at a front surface thereof, with a receiving chamber 20*a* to receive the ice maker 40 and the dispenser 50, and is installed with an auxiliary door 21 to open and close the receiving chamber 20*a*. The receiving chamber 20*a* has a recessed shape. The auxiliary door 21 is rotatably mounted, at one side thereof, at the door 20 to open and close the receiving chamber 20*a* while rotating about one side of the auxiliary door 21 in left and right directions. The auxiliary door 21 is provided, at a lower portion thereof, with a through hole 21*a* to allow a user to receive ice cubes discharged through the dispenser 50 at the outside of the auxiliary door 20.

Accordingly, when the ice maker 40 needs to be cleaned or repaired, a user may open the receiving chamber 20*a* through the auxiliary door 21 in a state in which the refrigerating chamber 11 is closed by the door 20, thereby facilitating repair or cleaning of the ice maker 40 in the receiving chamber 20*a*. Also, since the refrigerating chamber 11 is maintained in the closed state, regardless of whether or not the receiving chamber 20*a* is opened, food in the refrigerating chamber 11 may be preserved in a refrigerated state.

Figure 3:
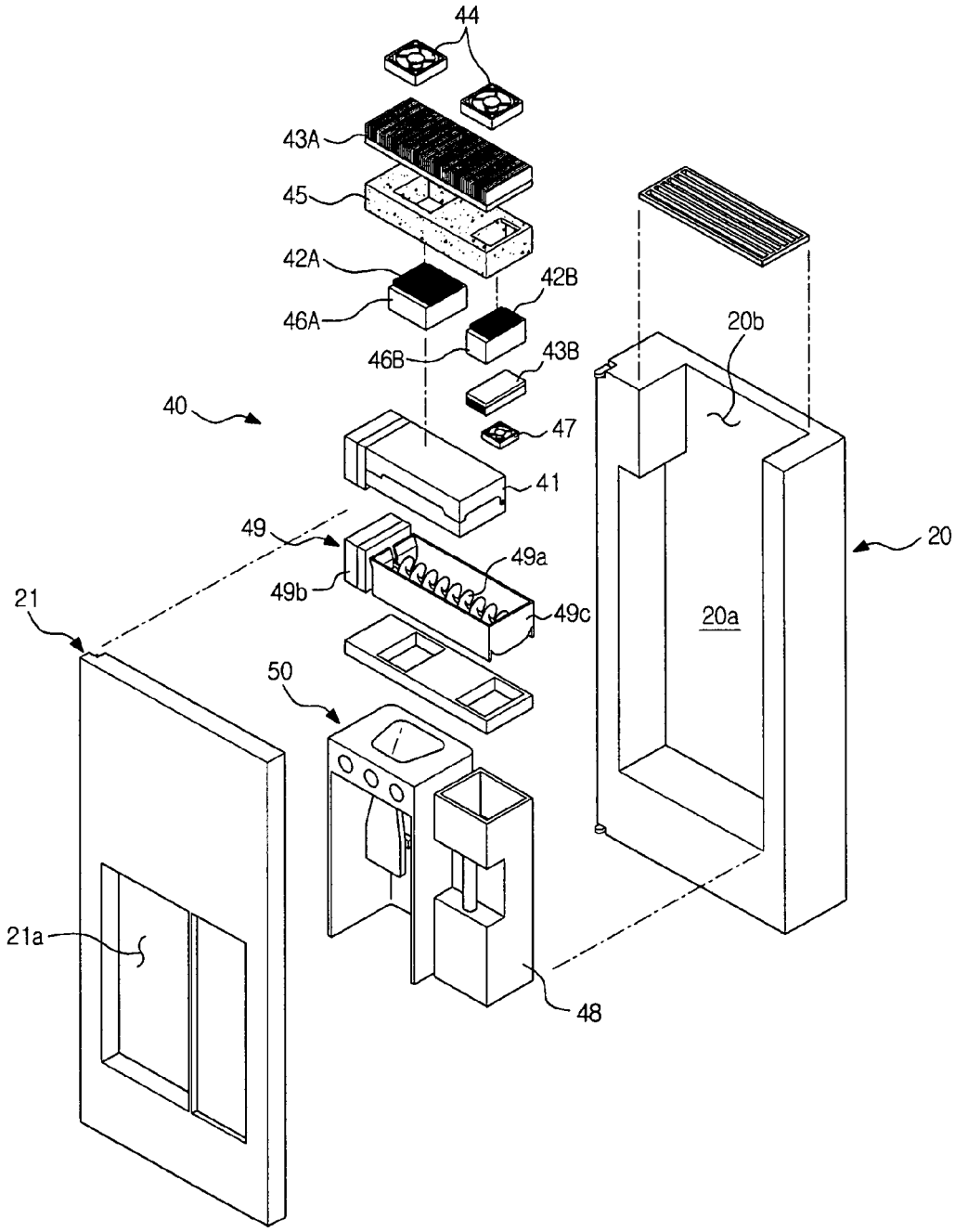
FIG. 3 is an exploded perspective view illustrating the ice maker installed in the refrigerator according to the exemplary embodiment of the present disclosure.
Figure 4:
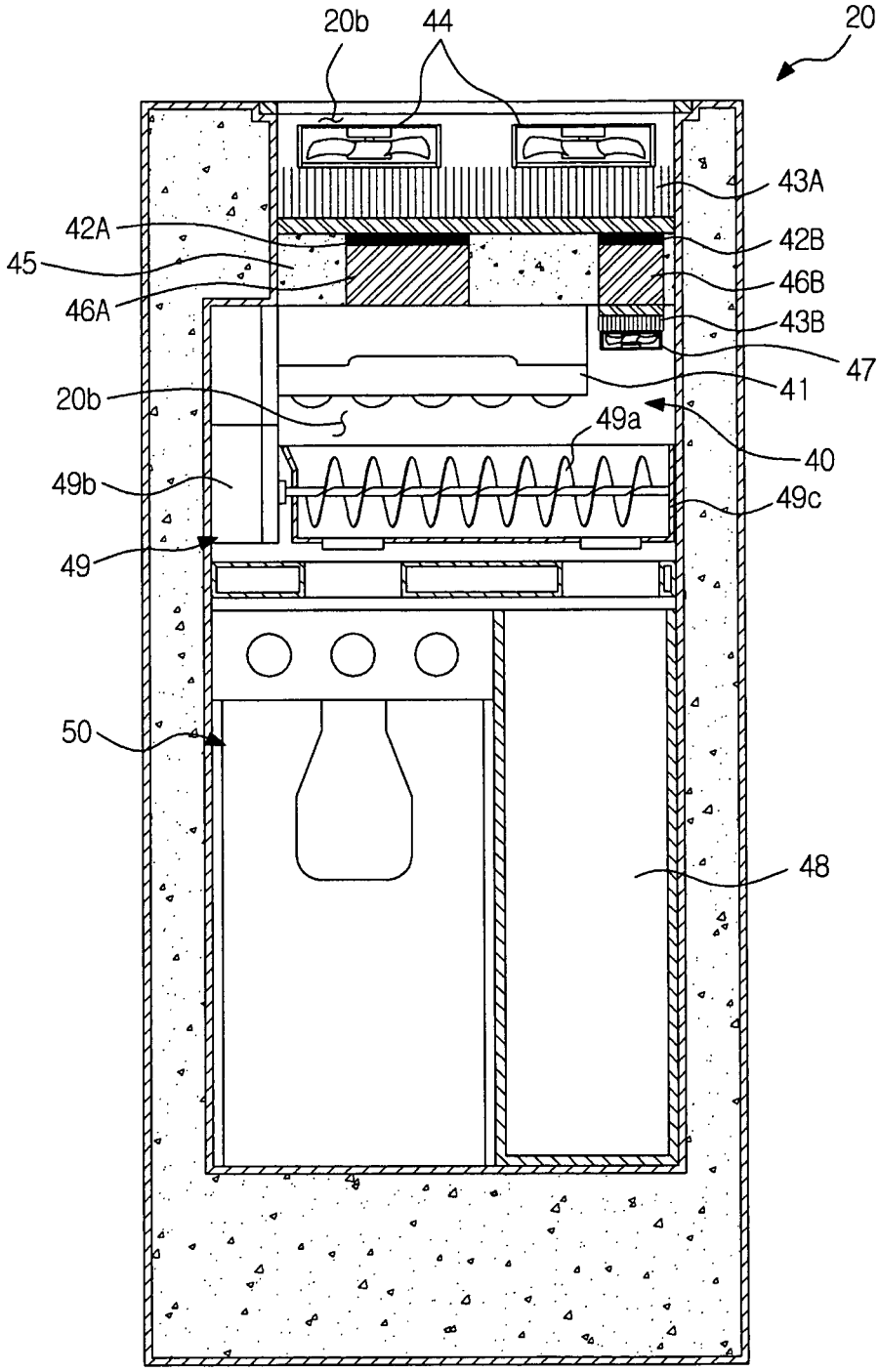
FIG. 4 is a sectional view illustrating the ice maker installed in the refrigerator according to the exemplary embodiment of the present disclosure.

As shown in FIGS. 3 and 4, the ice maker 40 includes an ice making tray 41 to make ice cubes, and a first Peltier element 42A to absorb heat from the ice making tray 41 through one side thereof and emit the heat through the other side thereof. In this case, the ice making tray 41 may be made of a metal material such as aluminum having a superior heat transfer rate.

Thus, ice making by the ice maker 40 is executed by the first Peltier element 42A independently of cooling in the refrigerating and freezing chambers 11 and 12. Accordingly, when the ice making by the ice maker 40 is executed independently of the cooling in the refrigerating and freezing chambers 11 and 12, smell of food stored in the refrigerating and freezing chambers 11 and 12 is not diffused to the ice maker 40 side. As a result, it may be possible to prevent smell of the food from permeating ice cubes.

As described above, the heat emitted from the first Peltier element 42A is emitted to the outside of the refrigerator. To this end, the ice maker 40 includes a first radiating fin 43A to radiate the heat transferred from the first Peltier element 42A to outside air while exchanging heat with the outside air of the refrigerator, and radiating fans 44 to allow the outside air to exchange heat with the first radiating fin 43A. The door 20 is provided with a heat emission hole 20*b* to allow the outside air to exchange heat with the first radiating fin 43A. In the present exemplary embodiment, the heat emission hole 20*b* is formed at an upper end of the door 20, and the radiating fans 44 are arranged at the heat emission hole 20*b*. Also, the first radiating fin 43A is arranged at an inner side of the heat emission hole 20*b*, namely, a lower side of each radiating fan 44.

In order to prevent the cold air of the receiving chamber 20*a* from being leaked to the outside through the heat emission hole 20*b*, an insulating member 45 is arranged between the ice making tray 41 and the first radiating fin 43A, and a first heat transfer member 46A is mounted at the insulating member 45 while passing through the insulating member 45. One side of the first heat transfer member 46A comes into contact with the ice making tray 41 and the other side thereof comes into contact with the first radiating fin 43A, thereby transferring heat of the ice making tray 41 to the first radiating fin 43A. The first heat transfer member 46A is generally made of a metal material having a high heat transfer rate. Accordingly, heat of water received in the ice making tray 41 is absorbed through one side of the first Peltier element 42A via the first heat transfer member 46A, so that the water in the ice making tray 41 becomes ice cubes. The absorbed heat is emitted through the other side of the first Peltier element 42A. Since the other side of the first Peltier element 42A comes into contact with the first radiating fin 43A, the heat emitted from the first Peltier element 42A is emitted to the outside air passing through the first radiating fin 43A by the radiating fans 44.

Also, the receiving chamber 20*a* is provided with an ice cube storage container 48 arranged in parallel with the dispenser 50 at the side of the dispenser 50. The ice cube storage container 48 is mainly used when a number of ice cubes are necessary while being used to store a number of ice cubes for a long time. The ice cube storage container 48 is detachably installed at the receiving chamber 20*a* so that a user may separate the ice cube storage container 48 from the receiving chamber 20*a*, and then use ice cubes stored in the ice cube storage container 48 in a state in which the receiving chamber 20*a* is opened by the auxiliary door 21.

Figure 5:
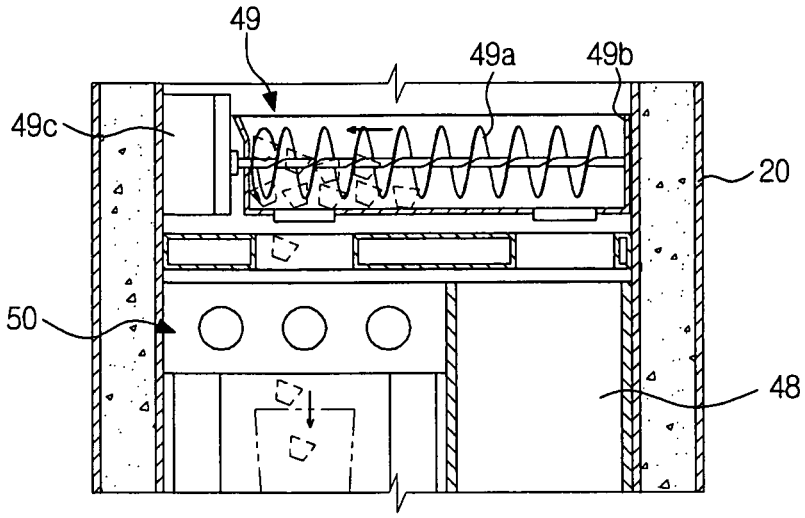
FIGS. 5 and 6 are sectional views illustrating operation of an ice cube feed device applied to the refrigerator according to the exemplary embodiment of the present disclosure.
Figure 6:
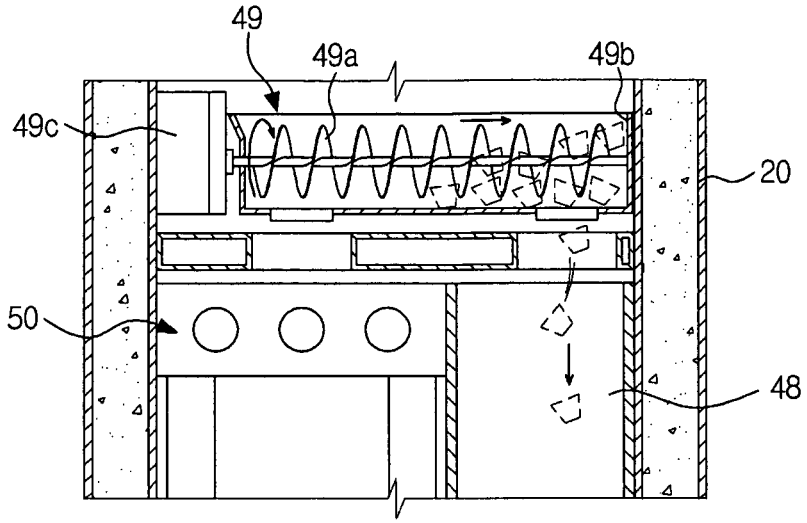

An ice cube feed device 49 is provided between the ice making tray 41 and the dispenser 50 so as to feed ice cubes into one of the dispenser 50 and the ice cube storage container 48. The ice cube feed device 49 includes an auger 49*a* rotated in normal and counter directions to guide ice cubes to one of the dispenser 50 and the ice cube storage container 48 according to the rotational direction of the auger 49*a*, a feed motor 49*b* connected to a shaft of the auger 49*a* to rotate the auger 49*a* in the normal and counter directions, and a temporary ice cube storage container 49*c* disposed at an inner side of the auger 49*a* to temporally store ice cubes. That is, when the auger 49*a* is rotated through the feed motor 49*b* in one direction, ice cubes in the temporary ice cube storage container 49*c* are moved toward an upper side of the dispenser 50 to be discharged through the dispenser 50, as shown in FIG. 5. On the other hand, when the auger 49*a* is rotated through the feed motor 49*b* in the counter direction, ice cubes in the temporary ice cube storage container 49*c* are moved toward an upper side of the ice cube storage container 48 to be discharged to the ice cube storage container 48, as shown in FIG. 6.

The interior of the receiving chamber 20*a* is maintained at or below a certain temperature in order to prevent ice cubes received in the ice cube storage container 48 and the temporary ice cube storage container 49*c* from thawing. To this end, the ice maker 40 includes a second radiating fin 43B arranged in parallel with the ice making tray 41 at the side of the ice making tray 41 to exchange heat with air within the receiving chamber 20*a*, and a second Peltier element 42B to absorb heat from the second radiating fin 43B through one side thereof and emit the heat through the first radiating fin 43A arranged to come into contact with the other side thereof. Further, a second heat transfer member 46B, which is mounted at the insulating member 45 while passing through the insulating member 45, is arranged between the second radiating fin 43B and the second Peltier element 42B so as to transfer heat from the second radiating fin 43B to the first Peltier element 42A through the insulating member 45. The second heat transfer member 46B is made of a metal material. A circulation fan 47 is arranged at a portion adjacent to the second radiating fin 43B to allow air within the receiving chamber 20*a* to exchange heat with the second radiating fin 43B by circulation of the air.

Accordingly, since air within the receiving chamber 20*a* exchanges heat with the second radiating fin 43B while being circulated by the circulation fan 47, heat of the air is absorbed into the second radiating fin 43B and the air is cooled during the process of heat exchange. The cooled air cools the interior of the receiving chamber 20*a* while circulating the interior of the receiving chamber 20*a* by the circulation fan 47 again. Here, heat absorbed through the second radiating fin 43B is absorbed into one side of the second Peltier element 42B through the second heat transfer member 46B, and is then emitted to the outside air through the first radiating fin 43A arranged at the other side of the second Peltier element 42B.

The present exemplary embodiment discloses a receiving chamber 20*a* provided at a door 20 to open and close a refrigerating chamber 11, but is not limited thereto. Thus, a receiving chamber may also be formed at a door to open and close a freezing chamber or a storage drawer.

As is apparent from the above description, a user may open the receiving chamber provided at the front surface of the door through the auxiliary door in the state in which the refrigerating chamber is closed by the door, thereby cleaning or repairing the ice maker within the receiving chamber. Consequently, the ice maker may be conveniently cleaned or repaired, and further loss of cold air in the refrigerating chamber may be prevented.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body provided with a storage chamber;

a door to open and close the storage chamber; and an ice maker to make ice cubes, wherein the door comprises a receiving chamber provided at a front surface of the door to be recessed so as to receive the ice maker, and an auxiliary door provided at the front surface of the door to open and close the receiving chamber.

2. The refrigerator according to claim 1, wherein the auxiliary door is rotatably mounted, at one side thereof, at the door to open and close the receiving chamber through rotation of the auxiliary door.

3. The refrigerator according to claim 1, further comprising:

a dispenser arranged at a lower side of the ice maker in the receiving chamber to discharge ice cubes made by the ice maker to the outside, wherein the auxiliary door is provided with an ice cube discharge hole to receive ice cubes discharged through the dispenser at the outside of the door.

4. The refrigerator according to claim 3, further comprising:

an ice cube storage container arranged in parallel with the dispenser to store ice cubes, and an ice cube feed device arranged between the ice maker and the dispenser to feed ice cubes made by the ice maker into one of the dispenser and the ice cube storage container.

5. The refrigerator according to claim 1, wherein the ice maker comprises:

an ice making tray to make ice cubes; and a first Peltier element to absorb heat of the ice making tray through one side of the first Peltier element and emit the heat through the other side thereof.

6. The refrigerator according to claim 5, wherein the ice maker further comprises:

a first radiating fin arranged to come into contact with the other side of the first Peltier element; and a radiating fan to allow outside air to exchange heat with the first radiating fin, the door being provided with a heat emission hole to allow the outside air to flow through the first radiating fin.

7. The refrigerator according to claim 6, wherein:

the heat emission hole is provided at an upper end of the door; and the heat emission hole is arranged with the radiating fan and is arranged, at a lower side thereof, with the first radiating fin.

8. The refrigerator according to claim 6, wherein the ice maker further comprises:

an insulating member arranged between the first radiating fin and the ice making tray; and a first heat transfer member to transfer heat to the first Peltier element through the insulating member.

9. The refrigerator according to claim 8, wherein the ice maker further comprises:

a second radiating fin arranged in parallel with the ice making tray;

a second Peltier element to absorb heat from the second radiating fin through one side of the second Peltier element and transfer the heat to the first radiating fin;

a circulation fan to allow air within the receiving chamber to exchange heat with the second radiating fin; and a second heat transfer member to transfer heat to the second Peltier element through the insulating member.

10. A refrigerator comprising:

a main body provided with a storage chamber;

an ice maker to make ice cubes; and a door provided with a receiving chamber to receive the ice maker while opening and closing the storage chamber, wherein the ice maker comprises an ice making tray to make ice cubes, and a first Peltier element to absorb heat of the ice making tray through one side of the first Peltier element and emit the heat through the other side thereof, and wherein the door has a heat emission hole to allow the heat emitted through the other side of the first Peltier element to directly exchange heat with outside air.

11. The refrigerator according to claim 10, wherein the ice maker further comprises:

a first radiating fin arranged to come into contact with the other side of the first Peltier element; and a radiating fan to allow the outside air to exchange heat with the first radiating fin.

12. The refrigerator according to claim 10, wherein:

the receiving chamber is provided at a front surface of the door; and the door further comprises an auxiliary door rotatably mounted, at one side thereof, at the door to open and close the receiving chamber through rotation of the auxiliary door.

13. The refrigerator according to claim 12, further comprising:

a dispenser to dispense the ice cubes made by the ice maker at the outside of the door; and an ice cube storage container to store a number of ice cubes.

14. The refrigerator according to claim 13, wherein the dispenser and the ice cube storage container are arranged in parallel in the receiving chamber, and the ice cube storage container is detachably installed in the receiving chamber so that a user separates the ice cube storage container from the receiving chamber.

* * * * *